US006144748A

United States Patent [19]

Kerns

[11] Patent Number: 6,144,748

[45] **Date of Patent: *Nov. 7, 2000**

[54] STANDARD-COMPATIBLE, POWER EFFICIENT DIGITAL AUDIO INTERFACE

[75] Inventor: Robert Q. Kerns, Burlingame, Calif.

[73] Assignee: Resound Corporation, Redwood City, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/831,469

[22] Filed: Mar. 31, 1997

[51] Int. Cl.[7] ..... H04R 25/00

[52] U.S. Cl. ..... 381/312; 381/314; 381/323

[58] Field of Search ..... 381/321, 328, 381/312, 32 D, 314, 315, 316, 317, 318, 322, 323, 324

[56] References Cited

U.S. PATENT DOCUMENTS

| | | | |
|---|---|---|---|
| 4,539,439 | 9/1985 | Strothmann et al. | 381/312 |
| 4,575,586 | 3/1986 | Topholm | 381/312 |
| 5,404,407 | 4/1995 | Weiss | 381/312 |
| 5,610,988 | 3/1997 | Miyahara | 381/68.4 |
| 5,710,819 | 1/1998 | Topholm et al. | 381/321 |
| 5,717,771 | 2/1998 | Sauer et al. | 381/328 |
| 5,721,783 | 2/1998 | Anderson | 381/328 |
| 5,727,070 | 3/1998 | Coninx | 381/312 |
| 5,757,932 | 5/1998 | Lindemann et al. | 381/316 |
| 5,835,610 | 11/1998 | Ishige et al. | 381/315 |
| 5,878,146 | 3/1999 | Andersen | 381/312 |
| 5,991,419 | 9/1999 | Brander | 381/312 |

*Primary Examiner*—Curtis A. Kuntz
*Assistant Examiner*—Rexford N Barnie
*Attorney, Agent, or Firm*—Burns Doane Swecker & Mathis L.L.P.

[57] ABSTRACT

A method and apparatus provided for interfacing a hearing device and an auxiliary device to achieve a wireless communications link between the hearing device and a remote device. The hearing device has a case including an external connector defining signal lines including power, ground, clock, data, and a further signal line. Circuitry is provided within the auxiliary device for exchanging control data with the hearing device using the clock and data signal lines and for exchanging audio information with the hearing device using one of 1) the clock and data signal lines; and 2) the further input signal.

33 Claims, 5 Drawing Sheets

STANDARD-COMPATIBLE, POWER EFFICIENT DIGITAL AUDIO INTERFACE

BACKGROUND OF THE INVENTION

1. Field of the Invention

The present invention relates to data input for hearing devices.

2. State of the Art

Hearing devices, such as hearing aids, are becoming increasingly sophisticated. Soon, it will be common for hearing aids in both BTE (Behind The Ear) and ITE (In The Ear) packages to be DSP (Digital Signal Processor) -based. In one expected design, a hearing aid will be realized using a three-chip chip set including an analog chip, a DSP chip and a memory chip.

Commonly, provision has been made for interfacing hearing aids to external devices. Such devices might include, for example, programming devices, test devices, etc. Clearly, the physical connection used for such an interface must be very small. One known connector uses five contacts and may be used to interface to the hearing aid a "piggy-back" auxiliary device housed in a package referred to as a "boot." A boot device might be used to augment the hearing aid battery, to realize a frequency-specific FM radio receiver, or for other uses. Referring to FIG. 1, a perspective view of conventional hearing device and auxiliary device packages shows the manner of connection of the devices.

Apart from hearing health care, hearing devices are expected to find increasing use in communications and computing. The input/output functions of a cellular telephone, for example, may be realized in the form of an earpiece that is physically separated from a pager-size radio unit but which is linked to the radio unit by a bidirectional digital audio link. The earpiece, besides being equipped with a miniature speaker, may also be equipped with a miniature microphone.

The radio unit may incorporate a degree of intelligence, e.g., voice-recognition capabilities. Using such a system, a user could simply say the words "Call home," in response to which the radio unit would recognize the verbal command and dial the appropriate number. When the call was answered, a normal telephone conversation could then proceed, almost as if the caller were speaking into thin air. In fact, the caller might be jogging outdoors, or be engaged in some other activity. Instead of telephony, the same sort of system may be used for entertainment—to listen to music, for example—or for instruction, or other purposes.

To enable existing hearing aid designs to be provided with the type of capabilities described, an audio interface is required that is compatible with existing designs and is capable of supporting the type of data transfer required by the target application—telephony, high-fidelity stereo, etc. Furthermore, the interface must be compatible with the usual hearing device constraints of miniature size and very low power consumption. The present invention addresses this need.

SUMMARY OF THE INVENTION

The present invention, generally speaking, provides a method and apparatus for interfacing a hearing device and an auxiliary device to achieve a wireless communications link between the hearing device and a remote device. The hearing device has a case including an external connector defining signal lines including power, ground, clock, data, and a further signal line. Circuitry is provided within the auxiliary device for exchanging control data with the hearing device using the clock and data signal lines and for exchanging audio information with the hearing device using one of 1) the clock and data signal lines; and 2) the further input signal.

BRIEF DESCRIPTION OF THE DRAWING

The present invention may be further understood from the following description in conjunction with the appended drawing in the drawing.

DETAILED DESCRIPTION OF THE PREFERRED EMBODIMENTS

Figure 1A:
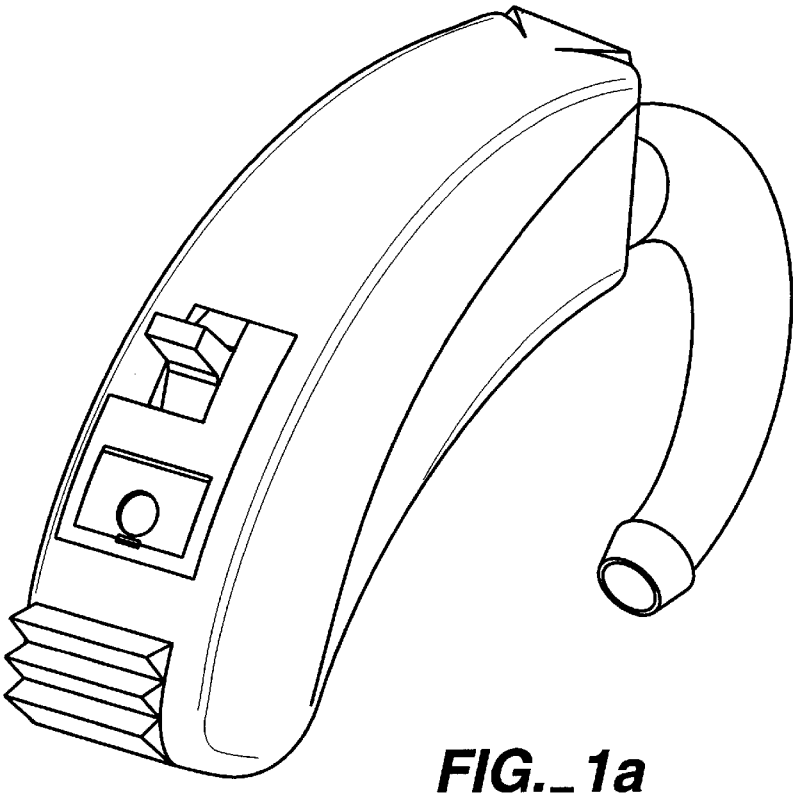
FIG. 1*a* is a perspective view of a conventional hearing device.
Figure 1B:
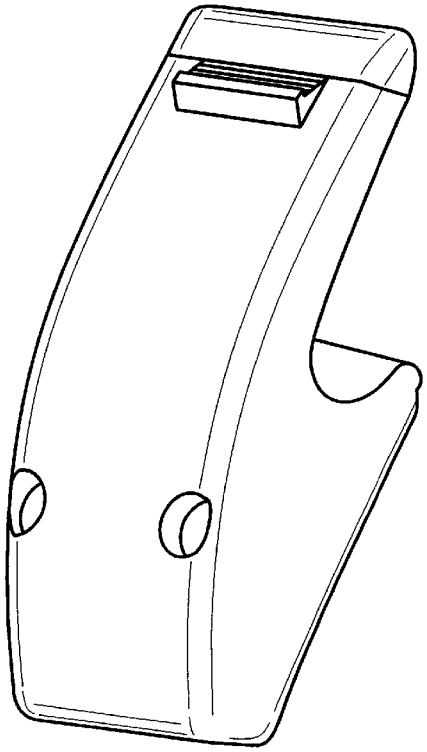
FIG. 1*b* is a perspective of an auxiliary device.
Figure 1C:
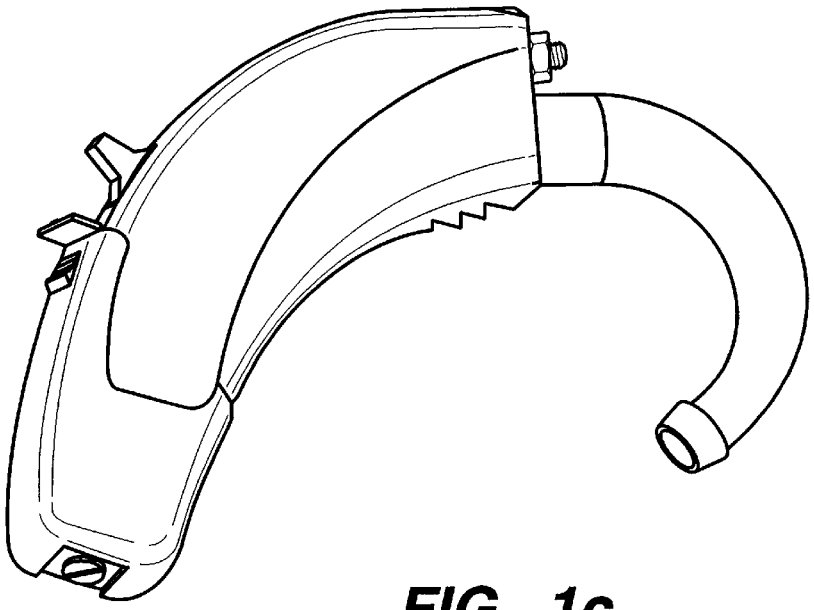
FIG. 1*c* is a perspective view of the auxiliary device connected to the hearing device.
Figure 1D:
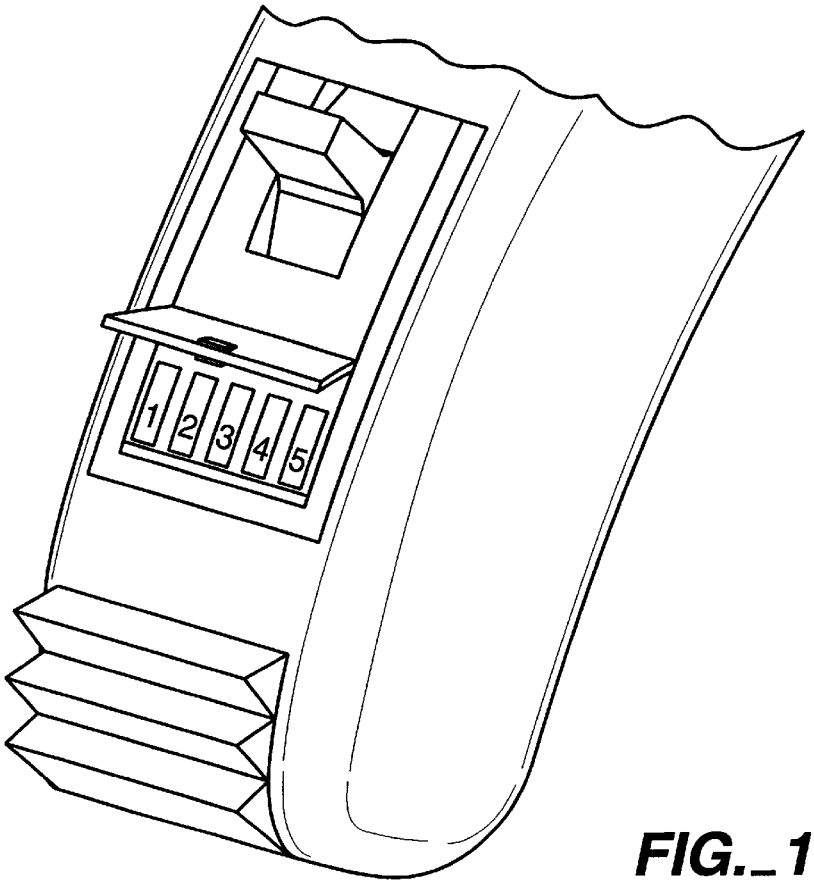
FIG. 1*d* is an enlarged view of a portion of the hearing device of FIG. 1*a* showing in greater detail a conventional connector; and auxiliary device packages showing the manner of connection of the devices.
Figure 2:
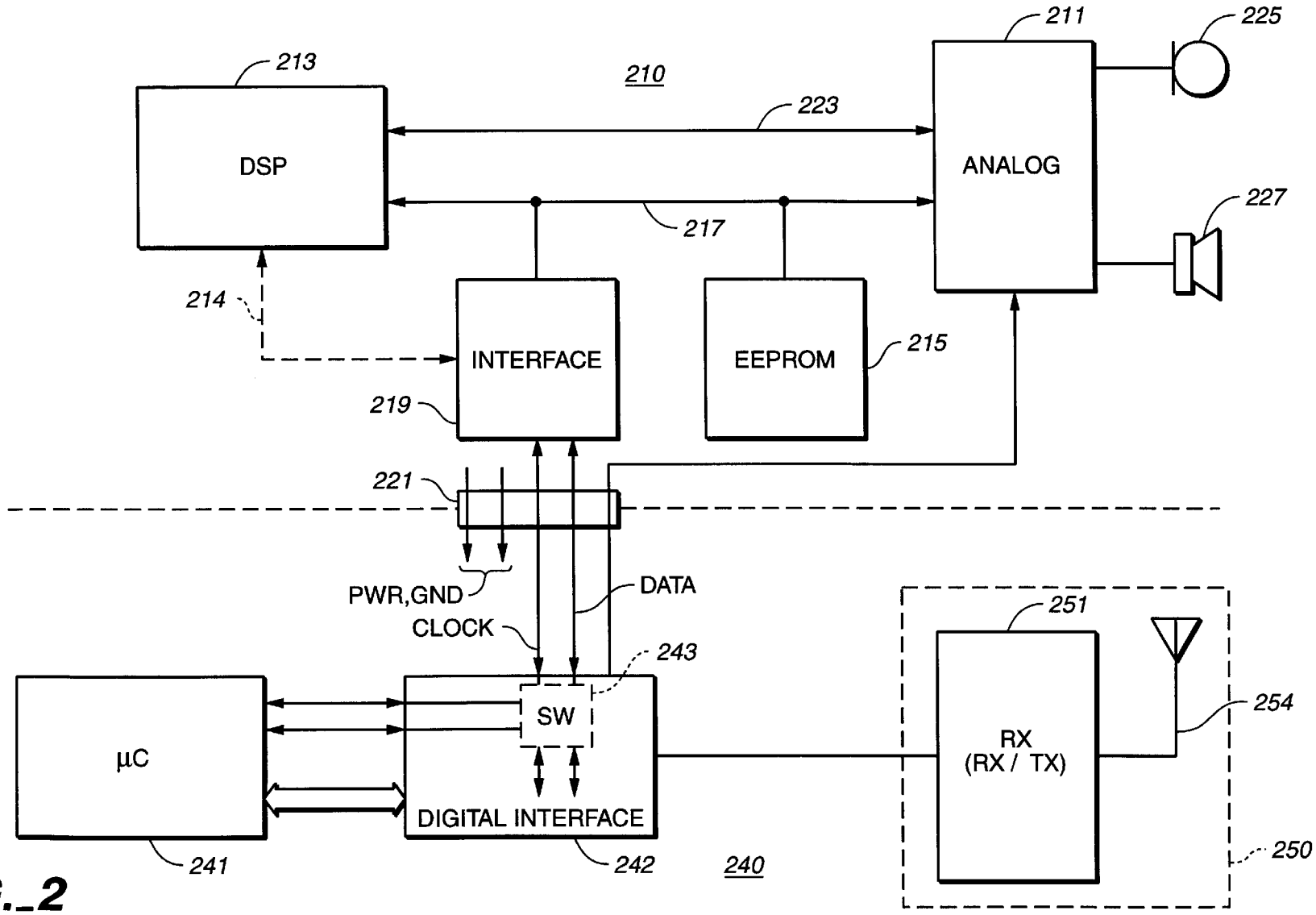
FIG. 2 is a block diagram of a hearing system incorporating a hearing device and an auxiliary device.

Referring now to FIG. 2, a block diagram is shown of a hearing system incorporating a hearing device 210 and an auxiliary device 240. The hearing device 210 is DSP-based and is realized using a three-chip chip set including an analog chip 211, a DSP chip 213 and a memory chip 215. The analog chip 211, DSP chip 213 and memory chip 215 are coupled to a common bus 217. The common bus may be an $I^2C$ bus, for example. The DSP chip 213 and the analog chip 211 are coupled by a separate audio bus 223. The analog chip 211 is coupled to a microphone 225 and a speaker 227. The common bus 217 is also coupled to an interface chip 219, which is connected to an external connector 221. The interface chip 219 is coupled to the common bus 217 for the purpose of interfacing to the auxiliary device 240. The external connector 221 may provide power and ground to the auxiliary device 240 as indicated. Furthermore, a Direct Audio Input (DAI) signal is coupled from the external connector 221 to the analog chip 211.

In operation of the hearing device of FIG. 2 (absent the auxiliary device), the analog chip 211 produces audio samples of sounds picked up by the microphone 225 and transmits the audio samples across the audio bus 223 to the DSP 213. The DSP 213 processes the audio samples and produces an audio signal. The audio signal is transmitted back to the analog chip 211 on the audio bus 223. The audio signal may be an analog signal that is filtered within the analog chip 211 before being applied to the speaker 227.

The auxiliary device 240 realizes a wired or wireless communications link for delivering audio information to the hearing device 210. In one embodiment, the auxiliary device 240 receives an audio signal and delivers an analog audio signal to the hearing device 210. The source of the analog audio signal may be a personal audio device such as a tape player, for example. In another embodiment, the auxiliary device 240 operates to receive and optionally transmit real-time data, in particular digital audio signals.

The transmit and receive capabilities of the auxiliary device 240 may be used to realize a bidirectional communications link, for example a bidirectional communications link to the cellular telephone network.

Referring still to FIG. 2, in one embodiment, the auxiliary device is microcontroller-based. Input and output of information to and from a microcontroller 241 is accomplished through a digital interface unit 242. The digital interface unit 242 is coupled in turn to an RF section 250. The RF section 250 includes an RF receiver or RF transponder 251 and an antenna 254. In a basic embodiment, a D/A converter 244 is coupled between the digital interface unit 242 and the DAI signal line of the external connector 221 and is used to produce an analog audio signal. In this embodiment, the RF section 250 may include an RF receiver only.

The microcontroller 241 of the auxiliary device 240 provides for connection of a standardized serial bus 244, e.g., the $I^2C$ bus. When the auxiliary device 240 is connected to the external connector 221, control data may be exchanged between the microcontroller 241 and the various chips within the hearing device 210, through the interface chip 219. In the basic embodiment, an analog audio signal is provided to the hearing device 210 via the DAI line.

In a more advanced embodiment, a bidirectional digital audio link is established between the hearing device 210 and the auxiliary device 240. The $I^2C$ protocol is not optimized for either high data rates or low power requirements and is therefore not well-suited for exchanging digital audio data. However, the DSP 213 of the hearing device 210, besides being coupled to the $I^2C$ bus 217, is provided with a port for connecting to a four-wire digital audio bus 214 of a type co-developed by Sony and Philips Corporations. For purposes of digital audio communications, it is desirable for the auxiliary device 240 to communicate with the DSP 213 through the bus 214. For control purposes, however, it is desirable to preserve the ability to communicate with the chips of the hearing device using the $I^2C$ (or other inter-IC) bus 217. In addition, space constraints dictate that the conventional connector remain unaltered 221. In order to satisfy these various requirements, the interface chip 219 connects to the conventional connector 221 and functions as a multi-protocol serial bus bridge.

Within the auxiliary device 240, a switch 243 within the digital interface chip 242 is coupled to CLOCK and DATA lines of the conventional connector 221. The switch 243 is controlled to connect the lines to either the $I^2C$ bus 244 of the microcontroller 241 or to CLOCK and DATA lines within the digital interface chip 242.

Figure 3:
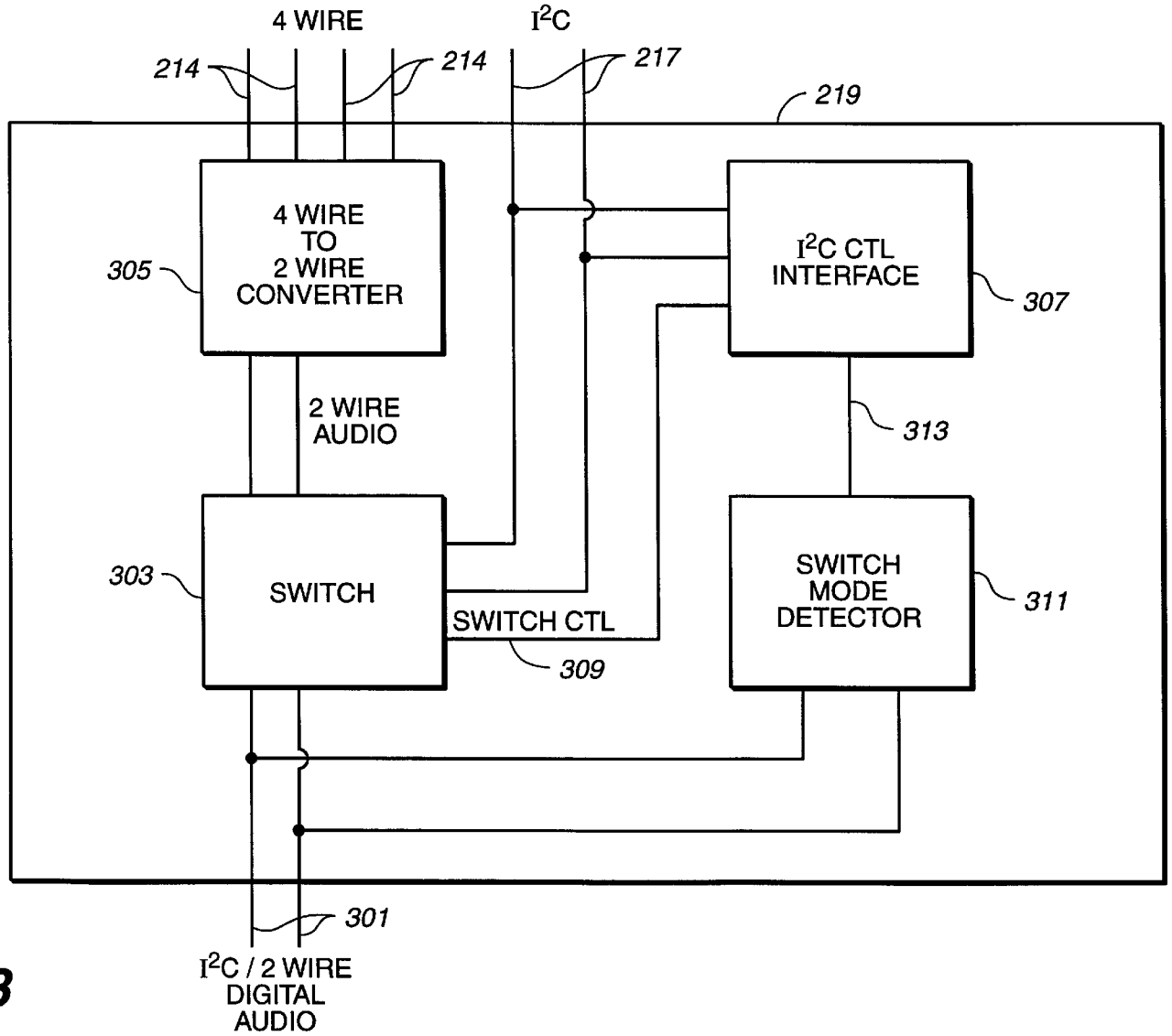
FIG. 3 is a more detailed block diagram of the interface circuit of FIG. 2.

Referring to FIG. 3, the interface chip 219 of the hearing device 210 is shown in greater detail. The lines 301 form a multi-protocol, $I^2C$/two-wire digital audio bus (dual bus). A switch 303 connects the dual bus to either the $I^2C$ bus 217 or to a four-wire to two-wire converter 305. The converter 305 is connected to the bus 214. An $I^2C$ control interface 307 is connected to the $I^2C$ bus 217. The $I^2C$ control interface 307 produces a signal 309 for controlling the switch 303.

Also connected to the dual bus is a switch mode detector 311. The switch mode detector 311 produces a signal 313 that is input to the $I^2C$ control interface 307.

In operation, when the interface chip 219 is powered up, the switch 303 is set to connect the dual bus 301 to the $I^2C$ bus 217. With the switch 303 in this position, the microcontroller 241 is coupled to the $I^2C$ bus 217. Furthermore, either the microcontroller 241 or the DSP 213 can communicate with the $I^2C$ control interface 307 to cause the switch 303 to be changed to the other position (the data transfer position) used to digital audio communications.

Figure 4:
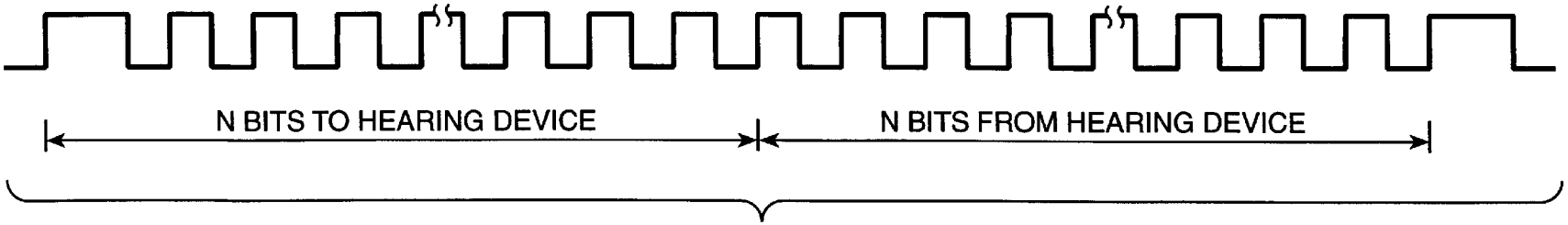
FIG. 4 and FIG. 5 are timing diagrams illustrating a protocol employed in the system of FIG. 2 in accordance with a preferred embodiment of the invention.

Referring to FIG. 4, the protocol employed for two-wire digital audio communications is simple and involves little overhead. It is therefore more ideally suited than the $I^2C$ protocol for high-speed, low-power digital data communications. Communications are framed using an elongated clock pulse. During each frame, some number of bits of audio data is sent to the hearing device in accordance with various communications options, described below. Immediately thereafter, the same number of bits of audio data is received from the hearing device.

A variable clock rate is generated by the digital interface 242 that is no greater than required to support the desired data rate. For example, in one mode, eight-bit samples are exchanged in each direction between the auxiliary device and the hearing device at a rate of 8000 samples per second each direction. The digital interface therefore generates a clock having a rate of 128 kcps. The clock rate may vary during use according to external events. For example, a telephone call might be received during a time in which high fidelity audio signals are being supplied to the hearing device. The rate would then be substantially reduced to a rate commensurate with the lower data rate of the telephone call, conserving power.

With the switch 303 in the data transfer position, the DSP 213 still enjoys communication with the $I^2C$ control interface 307 and is able to command the interface 307 to change the switch back to the $I^2C$ position. Note, however, that the auxiliary device 240 can then no longer communicate directly with the $I^2C$ control interface 307 to cause it to switch the switch 303. The switch mode detector 311 is provided for this purpose.

Figure 5:
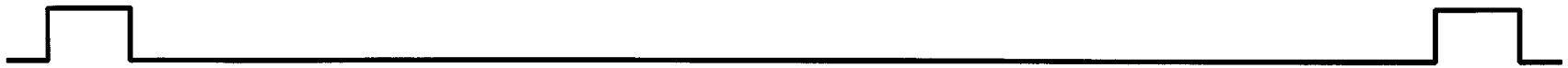

Referring more particularly to FIG. 5, when the switch 303 is in the data transfer position and a decision is made in the auxiliary device 240 to change the switch 303 back to the $I^2C$ position, the digital interface chip 242 grounds the CLOCK line of the dual bus 301. If the CLOCK line remains grounded for a specified duration as determined by the switch mode detector 311 according to its internal clock signal, the switch mode detector 311 asserts the signal line 313. The $I^2C$ control interface 307 responds by changing the switch 303 to the $I^2C$ position. The duration may be the duration of a communications frame.

The functions of the pins of the external connector 221 in various modes are shown in Table 1. Of particular interest for purposes of the present invention are the ANALOG and DIGITAL modes.

TABLE 1

| Pin Name | Function | MODE: DEFAULT (No Boot) | ANALOG (Analog Input Only Boot) | PROGRAMMING (Analog Input With $I^2C$ Programming Boot) | DIGITAL (Digital I/O Boot) |
|---|---|---|---|---|---|
| 1. V + | Battery voltage from hearing device to supply the interface to the external device. This is typically the raw 1.0 to 1.2 volt hearing aid battery voltage. | Battery (V +) | Battery (V +) | Battery (V +) | Battery (V +) |
| 2. GND | System Ground | Ground | Ground | Ground | Ground |
| 3. CLOCK | System Clock Line | Pullup to V + | Pullup to V + | Connected to External $I^2C$ Bus | Connected to 2 Wire Digital Audio Bus |
| 4. DATA | System Data Line | Pullup to V + | Pullup to V + | Connected to External $I^2C$ Bus | Connected to 2 Wire Digital Audio Bus |
| 5. DAI | Direct Audio Input - an analog signal line | Floating | Connected to Analog Audio Signal | Connected to Analog Input | Grounded |

Within the DIGITAL mode, the hearing system may be switched between Data Mode which uses the bus 214 and Control Mode which uses the $I^2C$ bus. For Data Mode, various conversion modes, sample size and data rate options may be set. Command registers within the interface chip 219 are used to control these various modes and options, as shown in Table 2.

TABLE 2

| CONTROL REGISTER | FIELD: MODE (BIT 0) | RESERVED (BIT 1) | CONVERSION MODE (BITS 2–3) | SAMPLE SIZE EAR TO RPU (BITS 4–5) | SAMPLE SIZE EAR TO RPU (BITS 6–7) | SAMPLE RATE RPU TO EAR (BITS 0–3) | SAMPLE RATE EAR TO RPU (BITS 4–7) |
|---|---|---|---|---|---|---|---|
| 0: $I^2C$ Address 1011000 | 0 = $I^2C$ bus Control Mode<br>1 = [Name] bus Data Mode | | 0 = Linear conversion<br>1 = A Law to linear<br>2 = MU law to linear | 0 = 8 bit samples<br>1 = 12 bit samples<br>2 = 14 bit samples<br>3 = 16 bit samples | 0 = 8 bit samples<br>1 = 12 bit samples<br>2 = 14 bit samples<br>3 = 16 bit samples | | |
| 1: $I^2C$ Address 1011001 | | | | | | 0 = 8000 samples per second (sps)<br>1 = 11000 sps<br>2 = 16000 sps<br>3 = 22000 sps<br>4 = 32000 sps<br>5 = 44100 sps<br>6 = 48000 sps | 0 = 8000 sps<br>1 = 11000 sps<br>2 = 16000 sps<br>3 = 22000 sps<br>4 = 32000 sps<br>5 = 44100 sps<br>6 = 48000 sps |

It will be apparent to those of ordinary skill in the art that the present invention can be embodied in other specific forms without departing from the spirit or essential character thereof. The disclosed embodiments are therefore regarded in all respects to be illustrative and not restrictive. The scope of the invention is indicated by the appended claims rather than the foregoing description, and all changes which come within the meaning and range of equivalents thereof are intended to be embraced therein.

What is claimed is:

1. A method of augmenting the functions of a hearing device, the hearing device having a case including an external connector defining multiple signal lines not conventionally used to communicate bidirectional digital audio signals, the method comprising:

providing an auxiliary device in an auxiliary case having a mating connector for engaging said external connector, the auxiliary device including interface circuitry and protocol instructions defining a protocol for communicating bidirectional digital audio signals through the external connector;

engaging the mating connector and the external connector and mechanically securing together said case and said auxiliary case such that a mating surface of said case adjoins a corresponding mating surface of said auxiliary case; and communicating digital audio data bidirectionally between the auxiliary device and the hearing device.

2. The method of claim 1, wherein the functions of the hearing device are augmented to provide a communications link between the hearing device and a remote device, further comprising communicating data between the auxiliary device and the remote device.

3. The method of claim 2, wherein the signal lines include a clock signal and wherein communicating audio data comprises the auxiliary device modifying the clock signal to present a distinctive sync pulse and sending a predetermined number of data samples on the data line, followed by the hearing device modifying the clock signal to present a distinctive sync pulse and sending an equal number of data samples on the data line.

4. The method of claim 2, comprising the further step of communicating control data from the auxiliary device to the hearing device.

5. The method of claim 4, wherein the signal lines include a clock signal and a data signal and wherein audio data and control data are both communicated to the hearing device using the clock and data signals.

6. The method of claim 5, wherein the hearing device includes a digital signal processor having first and second serial ports, the second serial port being capable of exchanging audio samples at a rate of greater than 8,000 samples per second, the method comprising the further steps of:

switching the clock and data lines within the hearing device such that the clock and data lines are coupled to the first serial port for control communications and are coupled to the second serial port for audio data communications.

7. The method of claim 6, wherein the second serial port is a four-wire port, the method comprising the further steps of converting two-wire digital audio data received on the clock and data lines to four-wire digital audio data, and applying the four-wire digital audio data to the second serial port.

8. The method of claim 6, comprising the further step of switching the clock and data lines from the second serial port to the first serial port upon a predetermined signal applied by the auxiliary device to one of the clock and data lines.

9. The method of claim 8, wherein the predetermined signal comprises grounding the clock line for a predetermined number of clock cycles.

10. Apparatus for interfacing a hearing device and an auxiliary device to be worn by a user with the hearing device, the hearing device having a case including an external connector defining multiple signals lines not conventionally used to communicate bidirectional digital audio signals, the auxiliary device being provided in an auxiliary case having a mating connector for engaging said external connector such that a mating surface of said case adjoins a corresponding mating surface of said auxiliary case, the apparatus comprising:

interface circuitry and protocol instructions defining a protocol for communicating bidirectional digital audio signals through the external connector;

wherein the interface circuitry operates in multiple modes including at least a first mode for exchanging program data with the hearing device using clock and data signal lines and at least a second mode for exchanging audio information with the hearing device using one of 1) the clock and data signal lines; and 2) a further input signal.

11. The apparatus of claim 10, wherein a communications link is provided between the hearing device and a remote device as a result of the auxiliary device communicating with the hearing device and the remote device.

12. The apparatus of claim 10 wherein said circuitry comprises a switch for selectably connecting the clock and data lines to one of a microcontroller and a digital interface within the auxiliary device, and control logic for controlling the state of the switch.

13. The apparatus of claim 10, further comprising within the hearing device a data converter and a switch for selectably connecting the clock and data lines to one of a common bus of the hearing device and the data converter.

14. The apparatus of claim 13, wherein the data converter is connected to a serial port of a digital signal processor of the hearing device, the serial port having a higher maximum data throughput than said common bus.

15. The apparatus of claim 14, further comprising control logic coupled to and accessible from said common bus for causing the switch within the hearing device to switch from the data converter to the common bus.

16. The apparatus of claim 15, further comprising within the hearing device a detector coupled to the clock and data lines and to the control logic within the hearing device for detecting a predetermined condition of at least one of the clock and data lines and signalling the predetermined condition to the control logic within the hearing device, whereby the switch is switched from the data converter to the common bus.

17. The method of claim 13, wherein the auxiliary device includes a communications transceiver, and wherein said transmission by the auxiliary device is wireless transmission.

18. The method of claim 13, wherein said transmission by the auxiliary device is wired transmission.

19. The apparatus of claim 11, further comprising a third mode for exchanging audio information with the hearing device using the further input signal.

20. The apparatus of claim 19 wherein the further input signal is a Direct Audio Input signal.

21. The apparatus of claim 20 wherein, in the second mode, the clock and data signal lines are connected to a two-wire digital audio bus.

22. The apparatus of claim 11, wherein, when the earpiece and the auxiliary device are used together, the case and the auxiliary case are mechanically secured together.

23. The apparatus of claim 11 wherein, in the first mode, the clock and data signal lines are connected to a two-wire bus that follows an integrated circuit-to-integrated circuit communications protocol.

24. The apparatus of claim 19 wherein, in the third mode, the Direct Audio input signal is connected to an analog audio signal.

25. The apparatus of claim 24 wherein the clock and data signal lines are connected to a fixed potential.

26. The apparatus of claim 19 comprising a fourth mode in which the hearing device is operated without the auxiliary device.

27. The apparatus of claim 26 wherein, in the fourth mode, the clock and data signal lines are connected to a fixed potential.

28. A hearing device comprising:

an earpiece housed in a first housing, the earpiece including a digital processor for processing sound signals and an external connector defining multiple signals lines not conventionally used to communicate bidirectional digital audio signals;

an auxiliary device housed in a second housing and attached to the earpiece such that a mating surface of said first housing adjoins a corresponding mating surface of said second housing, the auxiliary device including a mating connector for engaging said external connector, and interface circuitry and protocol instructions defining a protocol for communicating bidirectional digital audio signals through the external connector.

29. The apparatus of claim 18, wherein the auxiliary device includes at least one of a wired or wireless communications receiver and a wired or wireless communications transmitter for communicating with a remote device other than the earpiece.

30. The apparatus of claim 29, wherein the auxiliary device includes a wired or wireless communications transceiver.

31. The apparatus of claim 29, wherein the first housing has an external connector and the second housing has a mating external connector.

32. The apparatus of claim 31, wherein, when the earpiece and the auxiliary device are used together, the first housing and the second housing are mechanically secured together.

33. For use with a hearing device, an auxiliary device comprising:

a housing including an external connector defining multiple signals corresponding to multiple signal lines of the hearing device that are not conventionally used to communicate bidirectional digital audio signals; and interface circuitry and protocol instructions defining a protocol for communicating bidirectional digital audio signals through the external connector.

* * * * *